US008769732B2

(12) United States Patent
Mrugala

(10) Patent No.: US 8,769,732 B2
(45) Date of Patent: Jul. 8, 2014

(54) DISPOSABLE SANITARY WASTE RECEPTACLE

(76) Inventor: Donna K. Mrugala, Milwaukee, WI (US)

( * ) Notice: Subject to any disclaimer, the term of this patent is extended or adjusted under 35 U.S.C. 154(b) by 1128 days.

(21) Appl. No.: 12/684,310

(22) Filed: Jan. 8, 2010

(65) Prior Publication Data

US 2010/0175178 A1 Jul. 15, 2010

Related U.S. Application Data

(60) Provisional application No. 61/143,445, filed on Jan. 9, 2009.

(51) Int. Cl.
*A47K 11/06* (2006.01)
*A47K 11/04* (2006.01)

(52) U.S. Cl.
CPC ..... *A47K 11/06* (2013.01); *A47K 11/04* (2013.01)
USPC ..... 4/484; 4/479

(58) Field of Classification Search
CPC ..... A47K 11/06; A47K 11/04
USPC ..... 4/449, 479, 484; 211/16
See application file for complete search history.

(56) References Cited

U.S. PATENT DOCUMENTS

| | | | | |
|---|---|---|---|---|
| 4,759,086 | A | 7/1988 | Booth-Cox | |
| 4,882,794 | A | 11/1989 | Stewart, III | |
| 5,960,487 | A * | 10/1999 | Hawkins et al. | 4/449 |
| 6,523,187 | B1 | 2/2003 | Brink et al. | |
| 6,532,605 | B1 | 3/2003 | Howell | |
| 7,073,212 | B1 | 7/2006 | Moffat | |
| 7,260,855 | B2 * | 8/2007 | Aycock | 4/484 |
| 2006/0080767 | A1 | 4/2006 | Dombe-Korody et al. | |
| 2008/0185353 | A1 * | 8/2008 | Immerman et al. | 211/16 |

* cited by examiner

*Primary Examiner* — Tuan N Nguyen
(74) *Attorney, Agent, or Firm* — James Ray & Assoc

(57) ABSTRACT

A disposable sanitary waste receptacle includes a water impermeable bag member manufactured from a first predetermined material and having a first predetermined shape and a first predetermined size. Such bag member has an opening at one end thereof and is removably disposable within a waste receiving portion of at least one of a potty chair, a toilet trainer, a bedpan, a commode, and a combination thereof such that such opening is held open for bodily waste to be deposited into such bag member. A securing mechanism is disposed around a perimeter of such opening for securing such bag member to such at least one of such potty chair, such toilet trainer, such bedpan, such commode, and such combination thereof. A disposable sanitary waste receptacle kit is also provided.

11 Claims, 8 Drawing Sheets

DISPOSABLE SANITARY WASTE RECEPTACLE

CROSS REFERENCE TO RELATED APPLICATION

This patent application is related to and claims priority from U.S. Provisional Patent Application Ser. No. 61/143,445 filed Jan. 9, 2009.

FIELD OF THE INVENTION

The present invention relates, in general, to a disposable sanitary waste receptacle and, more particularly, this invention relates to disposable sanitary waste receptacles for use in lining potty chairs, toilet trainers, commodes, and bed pans and the like, and receiving human bodily waste therein.

BACKGROUND OF THE INVENTION

Prior to the conception and development of the present invention, bed pans, potty chairs, commodes, toilet trainers, and the like, as are generally well known in the prior art, are used to aid individuals, and particularly the elderly and ill, in the process of elimination. Unfortunately, cleaning up bodily waste from potty chairs, bed pans, etc. may be difficult, unpleasant, and time consuming.

Specifically of interest to the present invention are the following: Moffat, U.S. Pat. No. 7,073,212, discloses a training potty for toilet training a child which has a base that sits on a ground surface and includes a cutout seat and a cavity. A circular bowl is housed within the cavity of the base and is removable from the base. The bowl has an outwardly extending lip and a top rim. An insertable liner may be placed within the bowl.

Stewart, III, U.S. Pat. No. 4,882,794, discloses a disposable waste containment unit including a bag. The unit may be of a size to be placed in a toddler training potty or in a bedpan.

Brink, et, al, discloses a liner apparatus having a base for resting on a toilet seat. A plurality of bags compressed one atop the other are removably attached to one another and to the base. Each bag includes a flexible tab removably attached to a next lower bag or to the base flange, each tab having a perforated construction such that a selected bag may be torn away after use.

Howell, U.S. Pat. No. 6,532,605, discloses a liner for use in a toilet receptacle such as a child's potty or a bedpan. The liner comprises a flexible sheet fabricated from biodegradable material. The sheet is liquid impermeable and capable of retaining human excrement. The central portion of the flexible sheet is adapted to assume a bag-like configuration so as to conform to the inner receptacle surfaces of a standard potty chair or bedpan.

Doombe-Carody, et al, U.S. Publication No. 20060080767 discloses a leak proof absorbent liner intended to be inserted into a toddler potty training chair and geriatric commode. The liners are comprised of a leak-proof outer shell and inner absorbent pad. The absorbent chemically treated pad absorbs liquid body waste and causes the liner to change color to excite and encourage training a child to use the potty chair so he or she can discover a mystery color within the liner.

Booth-Cox, U.S. Pat. No. 4,759,086, discloses a disposable receptacle for receiving bodily waste which includes a fluid permeable inner layer and in impermeable outer layer, with an absorbent outer layer in between, and a rim portion with fastening means to attach the receptacle so it depends downwardly through the hole in a bed pan or child's potty.

SUMMARY OF THE INVENTION

The present invention provides a disposable sanitary waste receptacle which includes a water impermeable bag member manufactured from a first predetermined material and having a first predetermined shape and a first predetermined size. Such bag member has an opening at one end thereof and is removably disposable within a waste receiving portion of at least one of a potty chair, a toilet trainer, a bedpan, a commode, and a combination thereof such that such opening is held open for bodily waste to be deposited into such bag member. A securing means is disposed around a perimeter of such opening for securing such bag member to such at least one of such potty chair, such toilet trainer, such bedpan, such commode, and such combination thereof.

According to another embodiment, a plurality of disposable sanitary waste receptacles is provided. Such plurality of disposable sanitary waste receptacles are formed integrally with each being releasably attached to the next at predetermined locations thereon for being dispensed one at a time. Each one of such plurality of disposable sanitary waste receptacles includes a water impermeable bag member manufactured from a first predetermined material and having a first predetermined shape and a first predetermined size. Such bag member has an opening at one end thereof and is removably disposable within a waste receiving portion of at least one of a potty chair, a toilet trainer, a bedpan, a commode, and a combination thereof such that such opening is held open for bodily waste to be deposited into such bag member. A securing means is disposed around a perimeter of such opening for securing such bag member to such at least one of such potty chair, such toilet trainer, such bedpan, such commode, and such combination thereof.

According to still another embodiment, a disposable sanitary waste receptacle kit includes a plurality of disposable sanitary waste receptacles releasably connected to each other in series. Each disposable sanitary waste receptacle includes: a water impermeable bag member manufactured from a first predetermined material and having a first predetermined shape and a first predetermined size, such bag member being removably disposable within a waste receiving portion of at least one of a potty chair, a toilet trainer, a bedpan, a commode, and a combination thereof for receiving bodily waste therein; a securing means disposed around a perimeter of such opening for securing such bag member to such at least one of such potty chair, such toilet trainer, such bedpan, such commode, and such combination thereof; and a holding and dispensing means engageable with such plurality of disposable sanitary waste receptacles for holding such plurality of disposable sanitary waste receptacles and dispensing each individually to a user one at a time as needed.

OBJECTS OF THE INVENTION

It is, therefore, one of the primary objects of the present invention to provide a disposable sanitary waste receptacle for use with an adult potty chair, bed pan, commode, toilet trainer, and the like which includes a bag member which can be inserted into the waste receptacle portion of such adult potty chair, such bed pan, such commode, such toilet trainer, and the like for receiving waste therein and thereafter which can be quickly and easily removed for disposal after receiving bodily waste.

Another object of the present invention is to provide a disposable sanitary waste receptacle for use with an adult potty chair to provide a clean, sanitary, easy means for disposal of human waste by lining the waste receptacle portion of such potty chair prior to elimination and thereafter simply lifting the device from within the potty chair.

Still another object of the present invention is to provide a disposable sanitary waste receptacle including a water impermeable bag member removably disposable within a waste receiving portion of at least one of a potty chair, a toilet trainer, a bedpan, a commode, and a combination thereof for receiving bodily waste therein. Such disposable waste receptacle further including a securing means for at least one of securing such disposable sanitary waste receptacle in position at least one of in and on a waste receiving portion of such potty chair, such toilet trainer, such bedpan, such commode, and such combination thereof and thereafter such securing means being useful for securing such water impermeable bag member in a closed position for disposal after receiving bodily waste therein.

Yet another object of the present invention is to provide a bag shaped disposable sanitary waste receptacle which includes at least one of elastic, a drawstring, and a combination thereof disposed around an opening of such bag shaped waste receptacle, for securing such disposable sanitary waste receptacle to at least one of a potty chair, a toilet trainer, a bedpan, a commode, and a combination thereof, such that such disposable waste receptacle can receive bodily waste therein and thereafter such at least one of such elastic, such drawstring, and such combination thereof can be used to secure such bodily waste within such disposable waste receptacle for disposal thereof.

Still another object of the present invention to provide a plurality of disposable sanitary waste receptacles which can be stored in roll form for being easily dispensed one at a time, as needed.

An additional object of the present invention is to provide a disposable waste receptacle kit which includes a plurality of disposable sanitary waste receptacles releasably joined together; such kit also including a holding and dispensing means for supporting such disposable sanitary waste receptacles and dispensing same, one at a time, to a user, as needed. It is meant that the disposable sanitary waste receptacles may be in roll form and the holding and dispensing means may include a hook for hanging the holding and dispensing means as well as including at least one removable bar upon which such roll may sit. Such disposable sanitary waste receptacles may be formed from a continuous plastic sheet including perforations by which each disposable waste receptacle may be torn from the next.

In addition to the various objects and advantages of the present invention described with some degree of specificity above it should be obvious that additional objects and advantages of the present invention will become more readily apparent to those persons who are skilled in the relevant art from the following more detailed description of the invention, particularly, when such description is taken in conjunction with the attached drawing figures and with the appended claims.

Figure 1:
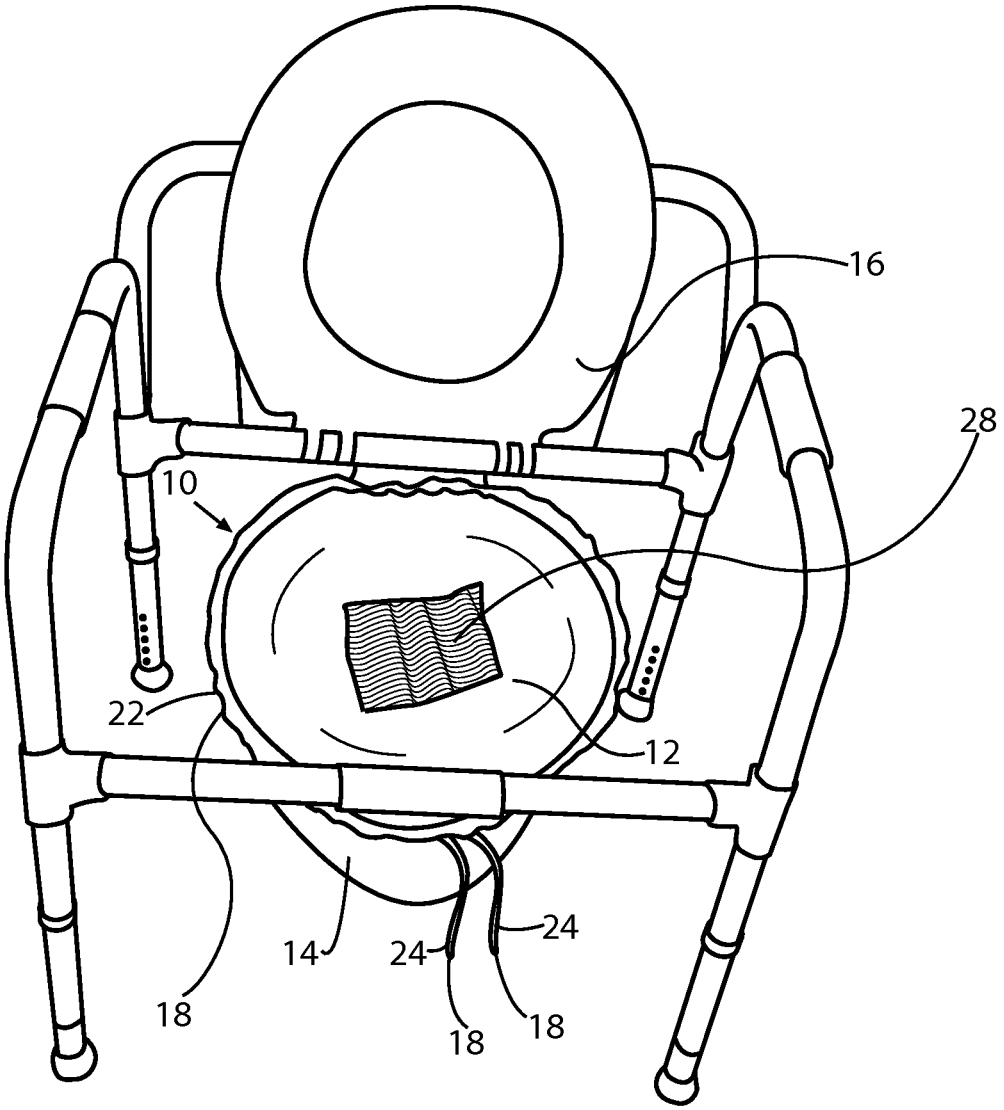
FIG. 1 is a partial perspective view of the invention according to one embodiment of the invention in which the bag member is depicted as being secured to an adult potty chair.

BRIEF DESCRIPTION OF A PRESENTLY PREFERRED AND VARIOUS ALTERNATIVE EMBODIMENTS OF THE INVENTION

Prior to proceeding to the more detailed description of the present invention it should be noted that, for the sake of clarity and understanding, identical components which have identical functions have been identified with identical reference numerals throughout the several views illustrated in the drawing figures.

Reference is now made, more particularly, to FIGS. 1-10.

Referring more specifically to FIGS. 1-5, the present invention provides a disposable sanitary waste receptacle, generally designated 10.

Such disposable sanitary waste receptacle 10 includes a water impermeable bag member 12 manufactured from a first predetermined material and having a first predetermined shape and a first predetermined size. It is presently preferred that such first predetermined material is plastic and is biodegradable.

Figure 2:
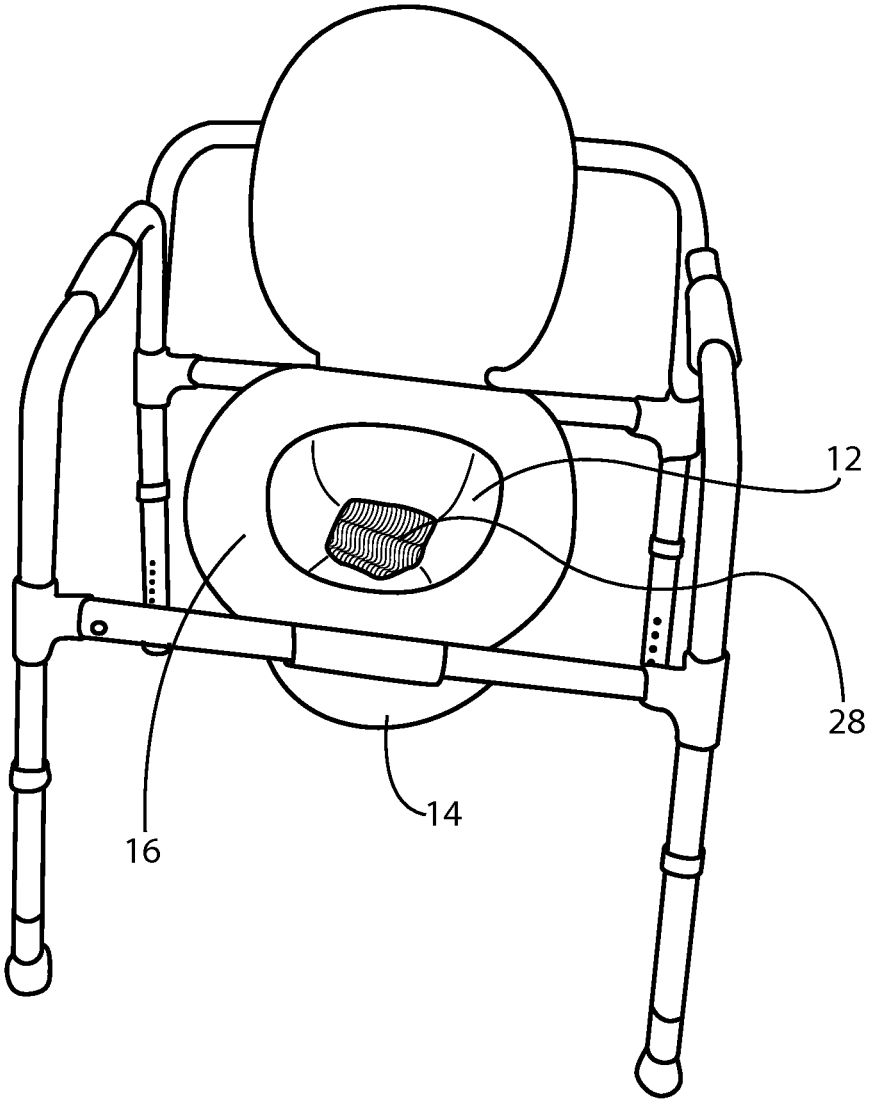
FIG. 2 is a partial perspective view of the invention according to one embodiment of the invention in which the device is in position on an adult potty chair ready to receive bodily waste.
Figure 3:
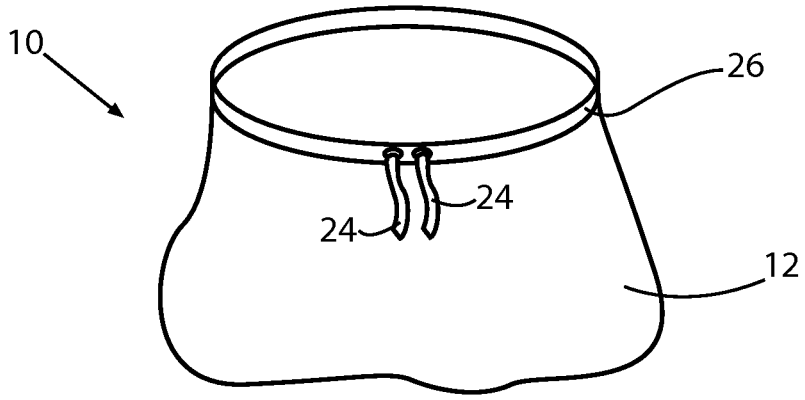
FIG. 3 is a partial perspective view of the invention according to one embodiment of the invention.
Figure 4:
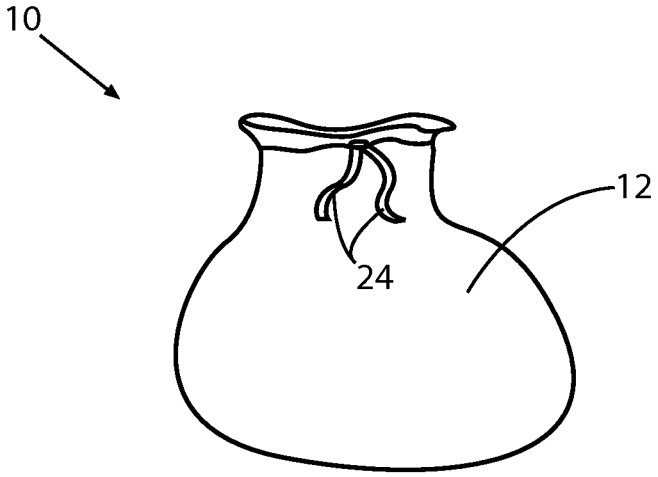
FIG. 4 is a partial perspective view of the invention according to one embodiment of the invention in which a drawstring securing means is depicted as securing the bag member in a closed position.

Such bag member 12 has an opening at one end thereof and is removably disposable within a waste receiving portion 14 of at least one of a potty chair, a toilet trainer, a bedpan, a commode, and a combination thereof such that such opening is held open for bodily waste (not shown) to be deposited into such bag member 12. As shown in FIGS. 1 and 2, such disposable sanitary waste receptacle is being used on an adult potty chair 16. It is presently preferred that each bag member have a diameter of between about 12 and about 24 inches and a depth of between about flinches and about 12 inches.

A securing means 18 is disposed around a perimeter of such opening of such bag member 12 for securing such bag member 12 to such at least one of such potty chair, such toilet trainer, such bedpan, such commode, and such combination thereof. It is presently preferred that such securing means 18 is at least one of elastic 22, a drawstring 24, and a combination thereof.

It is presently preferred that such bag member 12 further includes a hem 26 formed around a perimeter of such opening of such bag member 12. Preferably such at least one of such drawstring, such elastic, and such combination thereof is disposed within such hem 26. It is meant that such drawstring 24 may further be used to secure such opening of such bag member 12 in a closed position for securing such bodily waste within such bag member 12.

It is presently preferred that such disposable waste receptacle 10 further includes an absorbent member 28 having a second predetermined shape and a second predetermined size disposed within such bag member 12 at a predetermined location for absorbing such bodily waste. Preferably such absorbent member 28 is odor absorbent. It is further presently preferred that such absorbent member is also deodorizing. It is further presently preferred that such absorbent member is biodegradable.

Figure 9:
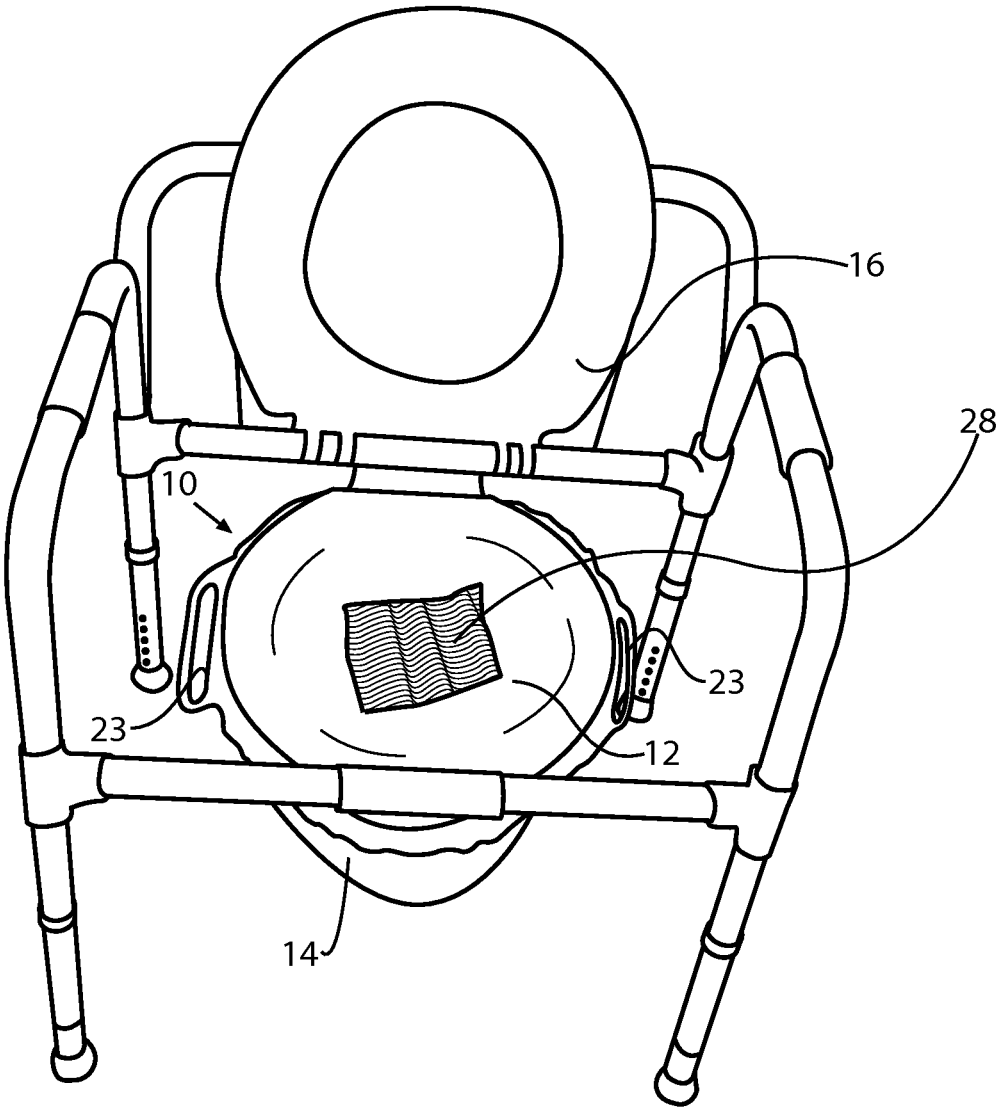
FIG. 9 is a partial perspective view of the invention according to one embodiment of the invention in which such securing means includes such bag member being stretchable such that a perimeter of such bag member closely adjacent such opening of such bag member may be stretched to conform around an outside edge of such waste receiving portion of at least one of a potty chair, a toilet trainer, a bedpan, a commode, and a combination thereof thereby securing such bag member in position for receiving such waste therein; such bag member includes a pair of handle members for use in easily lifting such bag member from such waste receiving portion.
Figure 10:
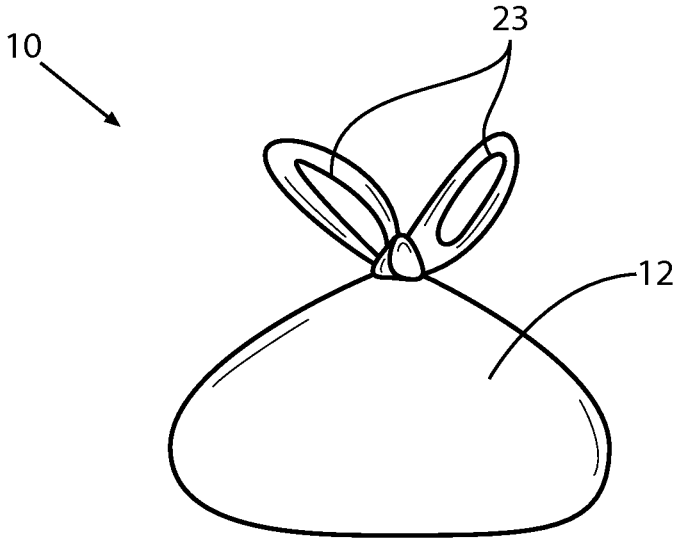
FIG. 10 is a partial perspective view of the invention according to one embodiment of the invention in which a pair of handle members attached to such bag member have been used to tie such bag member closed for securing waste therein for sanitary disposal.

According to another embodiment, as illustrated in FIGS. 9 and 10, such first predetermined material is stretchable such that when such bag member 12 is disposed within such waste receiving portion of such at least one of such potty chair, such toilet trainer, such bedpan, such commode, and such combination a perimeter around such opening of such bag member may be stretched to conform around an outside edge of such waste receiving portion of such at least one of such potty chair, such toilet trainer, such bedpan, such commode, and such combination thereof thereby securing such bag member 12 in position for receiving waste therein. Such bag member 12 may further include a pair of handle members 23 disposed thereon closely adjacent such first end thereof. Such handle members 23 may then be used to pull such bag member 12 off of such at least one of such potty chair, such toilet trainer, such bedpan, such commode, and such combination thereof and may be tied together by such user to secure such waste therein for sanitary disposal thereof.

It is meant that such device be able to be used to dispose of bodily waste without need for flushing such waste away. Instead, the user eliminates bodily waste into the bag member, secures the bag member in a closed position when ready for disposal, and then disposes of such device accordingly. Such bag member may also be manufactured in a variety of colors as desired.

Figure 5:
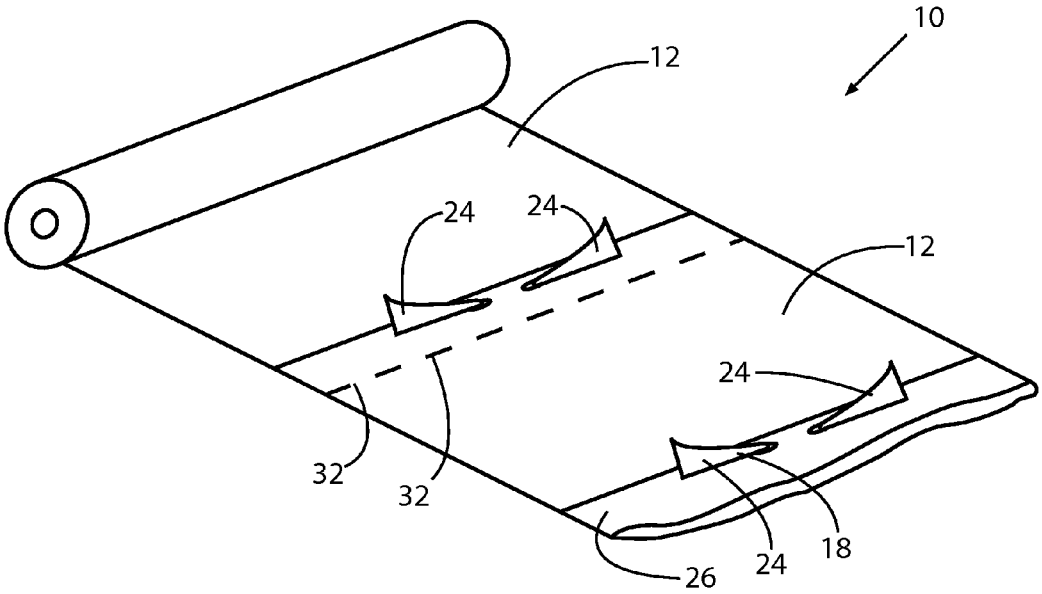
FIG. 5 is a partial perspective view of the invention according to one embodiment of the invention in which a plurality of disposable sanitary waste receptacles formed integrally are illustrated in roll form.

According to another embodiment, as illustrated in FIG. 5, a plurality of disposable sanitary waste receptacles, generally designated 10, is provided. Such plurality of disposable sanitary waste receptacles 10 are formed integrally with each being releasably attached to the next at predetermined locations thereon for being dispensed one at a time.

Each one of such plurality of disposable sanitary waste receptacles 10 includes a water impermeable bag member 12 manufactured from a first predetermined material and having a first predetermined shape and a first predetermined size. Such bag member 12 has an opening at one end thereof and is removably disposable within a waste receiving portion 14 of at least one of a potty chair, a toilet trainer, a bedpan, a commode, and a combination thereof such that such opening is held open for bodily waste to be deposited into such bag member 12.

It is presently preferred that such bag members 12 of such plurality of disposable sanitary waste receptacles 10 are formed in series from one continuous sheet of plastic, such plastic having perforations 32 by which each individual disposable sanitary waste receptacle may be torn from the next. Such plurality of disposable sanitary waste receptacles may be stored in roll form, each roll containing a predetermined number of disposable sanitary waste receptacles, for example, 25, 50, 75, 100, or any other number desired.

It is further presently preferred that an absorbent member 28 having a second predetermined shape and a second predetermined size is disposed within each of such bag members 12 at a predetermined location for absorbing such bodily waste.

A securing means 18 is disposed around a perimeter of such opening for securing such bag member 12 to such at least one of such potty chair, such toilet trainer, such bedpan, such commode, and such combination thereof.

Figure 6:
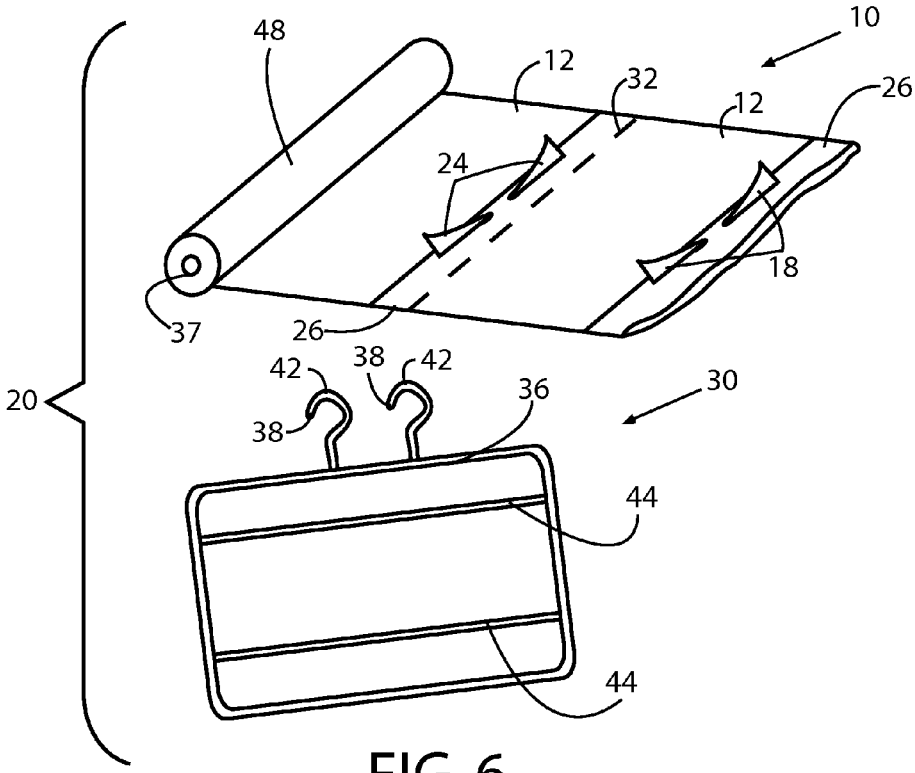
FIG. 6 is a partial perspective view of the invention according to one embodiment of the invention.
Figure 7:
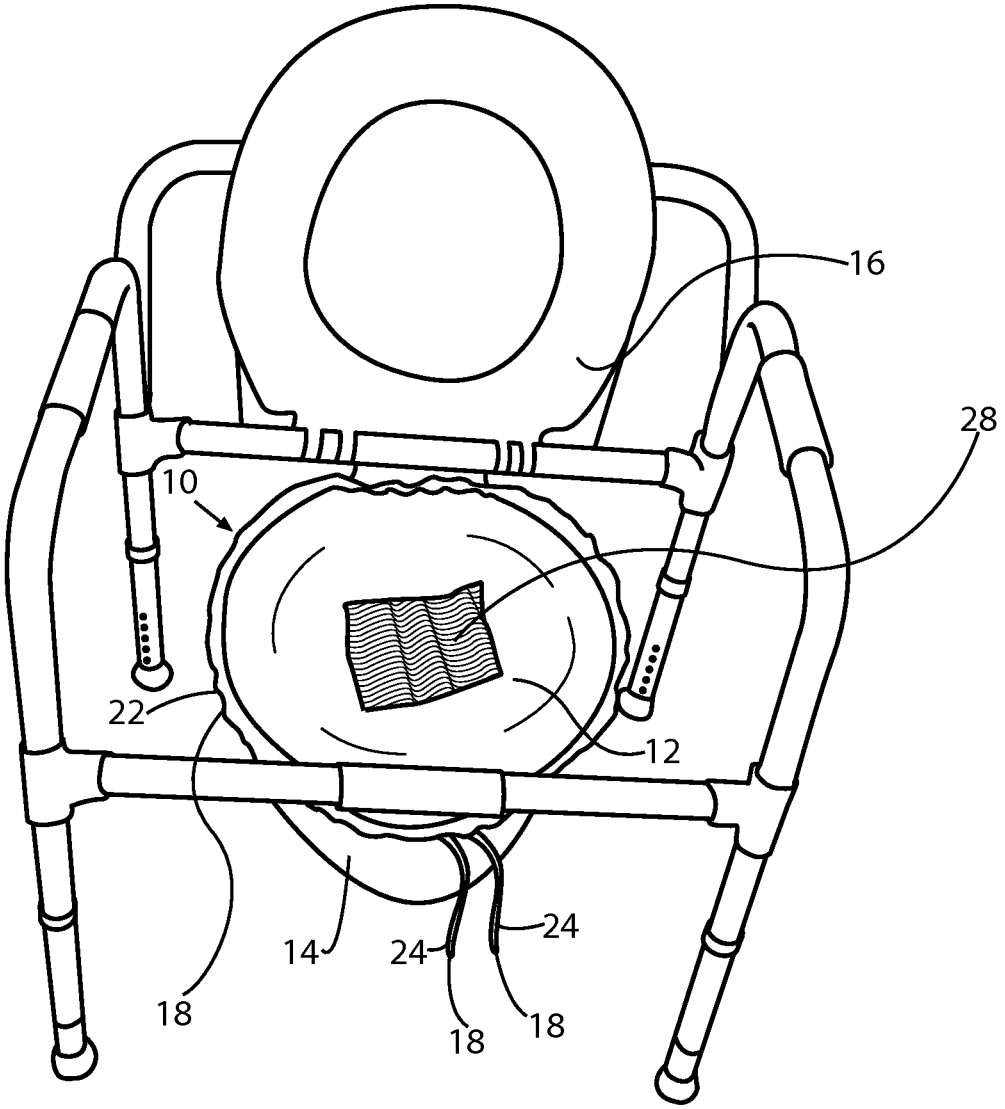
FIG. 7 is a partial perspective view of the invention according to one embodiment of the invention.
Figure 8:
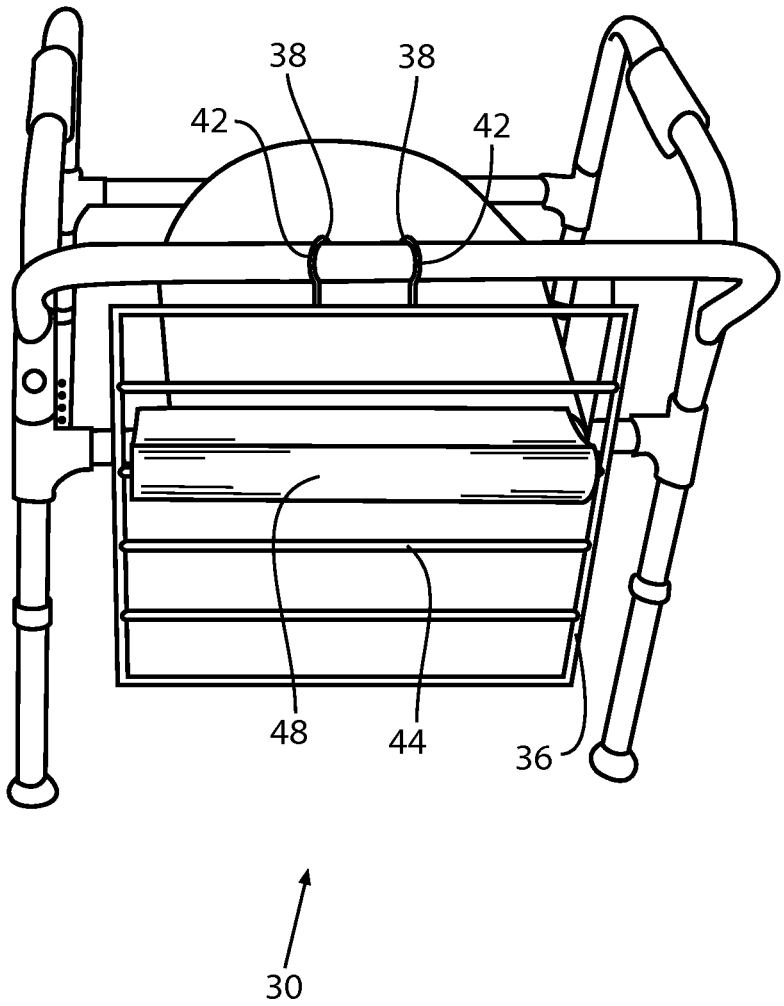
FIG. 8 is a partial perspective view of the invention according to one embodiment of the invention in which the holding and dispensing means is depicted as being hung from a rear portion of an adult potty chair.

According to yet another embodiment, as illustrated in FIGS. 6-8, a disposable sanitary waste receptacle kit, generally designated 20, includes a plurality of disposable sanitary waste receptacles, generally designated 10, releasably connected to each other in series. Each disposable sanitary waste receptacle 10 includes a water impermeable bag member 12 manufactured from a first predetermined material and having a first predetermined shape and a first predetermined size, such bag member 12 being removably disposable within a waste receiving portion 14 of at least one of a potty chair, a toilet trainer, a bedpan, a commode, and a combination thereof for receiving bodily waste therein.

Each disposable sanitary waste receptacle 10 further includes a securing means 18 disposed around a perimeter of such opening for securing such bag member 12 to such at least one of such potty chair, such toilet trainer, such bedpan, such commode, and such combination thereof.

A holding and dispensing means, generally designated 30 is engageable with such plurality of disposable sanitary waste receptacles 10 for holding such plurality of disposable sanitary waste receptacles 10 and dispensing each individually to a user (not shown) one at a time as needed.

It is presently preferred that such holding and dispensing means 30 includes a frame member 36 having an attachment means 38, preferably at least one hook 42 and most preferably at least two hooks, for releasably attaching such frame member 36 to a predetermined structure. The attachment means, however, is not meant to be limited as such and any attachment means may be used, for example, a snap-on type of attachment means, a pressure fit type attachment means, a twist tie type attachment means, etc. Such frame member 36 also includes at least one bar member 44 releasably attached to such frame member 36, such at least one bar member 44 being insertable into a hollow center portion 37 of a roll 48 of a predetermined number of disposable sanitary waste receptacles 10 for holding such roll 48 thereon such that such roll 48 may be rotated and each of such disposable sanitary waste receptacles 10 removed there from, one at a time, as needed.

It is presently preferred that such holding and dispensing means 30 includes two bar members such that two rolls of disposable sanitary waste receptacles may be supported simultaneously.

While a presently preferred and various alternative embodiments of the present invention have been described in sufficient detail above to enable a person skilled in the relevant art to make and use the same it should be obvious that various other adaptations and modifications can be envisioned by those persons skilled in such art without departing from either the spirit of the invention or the scope of the appended claims.

I claim:

1. A disposable sanitary waste receptacle kit comprising:

a. a plurality of disposable sanitary waste receptacles releasably connected to each other in series, each disposable sanitary waste receptacle including;

i. a water impermeable bag member manufactured from a stretchable material and having a first predetermined shape and a first predetermined size, said bag member comprising;

a. an opening at one end thereof and being removably disposable within a waste receiving portion of at least one of a potty chair, a toilet trainer, a bedpan, a commode, such that said opening is held open for bodily waste to be deposited into said bag member;

b. a securing means disposed around a perimeter of said opening for securing said bag member to said at least one of said potty chair, said toilet trainer, said bedpan, and said commode, wherein said perimeter of said bag member is closely adjacent to said opening of said bag member, such that said bag member conforms around an outside edge of said waste receiving portion of said at least one potty chair, said toilet trainer, said bedpan, and said commode; and c. a pair of handle members closely adjacent to said first end thereof for use in lifting said bag member from said waste receiving portion, wherein said handle members are continuous with said bag member, each handle member being defined by an opening through a wall thickness of said bag member; and b. a holding and dispensing means engageable with said plurality of disposable sanitary waste receptacles for holding said plurality of disposable sanitary waste receptacles and dispensing each individually to a user one at a time as needed, said holding and dispensing means includes:

i. a frame member;

ii. an attachment means for releasably attaching said frame member to a predetermined structure; and c. at least one bar member releasably attached to said frame member internal to peripheral edges thereof, said at least one bar member being insertable into a hollow center portion of a roll of a predetermined number of disposable sanitary waste receptacles for holding said roll thereon such that said roll is configured to rotate and each of said disposable sanitary waste receptacles removed there from, one at a time, as needed.

2. The disposable sanitary waste receptacle according to claim 1 wherein said each disposable waste receptacle further includes an absorbent member having a second predetermined shape and a second predetermined size disposed within said bag member at a predetermined location for absorbing such bodily waste.

3. The disposable sanitary waste receptacle according to claim 2 wherein said absorbent member is at least one of odor absorbent, deodorizing and a combination thereof.

4. The disposable sanitary waste receptacle according to claim 2 wherein said absorbent member is biodegradable.

5. The disposable sanitary waste receptacle according to claim 1 wherein said securing means is at least one of elastic, a drawstring, and a combination thereof.

6. The disposable sanitary waste receptacle according to claim 5 wherein said bag member further includes a hem formed around said perimeter of said opening.

7. The disposable sanitary waste receptacle according to claim 1 wherein said stretchable material is a plastic.

8. The disposable waste receptacle kit according to claim 1 wherein said attachment means is at least one hook.

9. The disposable waste receptacle kit according to claim 1 wherein said attachment means is at least two hooks.

10. The disposable waste receptacle kit according to claim 1 wherein said holding and dispensing means includes two bar members such that two rolls of disposable sanitary waste receptacles may be supported simultaneously.

11. A disposable sanitary waste receptacle kit comprising a vessel configured to receive a bodily waste and a disposable sanitary waste receptacle for lining said vessel, wherein said vessel comprises:

a. a waste receiving portion having an opening, an inside edge and an outside edge; and b. a sitting member hingedly connected to said waste receiving portion at one outside edge of said sitting member, said sitting member further having an opening therein; and wherein said disposable sanitary waste receptacle kit comprises:

a. a plurality of disposable sanitary waste receptacles releasably connected to each other in series, each disposable sanitary waste receptacle comprising:

i. a water impermeable bag member, ii. an opening at one end of said bag member and being removably disposable within said waste receiving portion such that said opening is held open for the bodily waste to be deposited into said bag member, iii. a securing means disposed around a perimeter of said opening for securing said bag member to said waste receiving portion, and iv. wherein said perimeter of said bag member is closely adjacent to said opening of said bag member, such that said bag member is configured to stretch to conform around an outside edge of said waste receiving portion;

b. a holding and dispensing means engageable with said plurality of disposable sanitary waste receptacles for holding said plurality of disposable sanitary waste receptacles and dispensing each individually to a user one at a time as needed, said holding and dispensing means including a frame configured for a hanging attachment on a structure of said vessel above said sitting member and one or more bar members disposed within the peripheral edges of said frame, each bar configured to support said plurality of disposable sanitary waste receptacles being provided in a roll form such that said roll is configured to rotate and said each disposable sanitary waste receptacles is separated from others on as needed basis; and c. a pair of handle members attached to said bag member adjacent to said first end thereof, wherein said handle members are continuous with said bag member, each handle member being defined by an opening through a wall thickness of said bag member.

* * * * *